US010101683B2

(12) United States Patent
Nishikawa et al.

(10) Patent No.: US 10,101,683 B2
(45) Date of Patent: Oct. 16, 2018

(54) TONER AND EXTERNAL ADDITIVE FOR TONER

(71) Applicant: CANON KABUSHIKI KAISHA, Tokyo (JP)

(72) Inventors: Koji Nishikawa, Susono (JP); Shuhei Moribe, Mishima (JP); Daisuke Yoshiba, Suntou-gun (JP); Shotaro Nomura, Suntou-gun (JP); Kosuke Fukudome, Tokyo (JP); Hiroki Akiyama, Toride (JP); Yojiro Hotta, Mishima (JP); Katsuhisa Yamazaki, Numazu (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/975,495

(22) Filed: Dec. 18, 2015

(65) Prior Publication Data

US 2016/0202624 A1 Jul. 14, 2016

(30) Foreign Application Priority Data

Jan. 8, 2015 (JP) ..... 2015-001936
Dec. 10, 2015 (JP) ..... 2015-240889

(51) Int. Cl.
*G03G 9/097* (2006.01)

(52) U.S. Cl.
CPC ..... *G03G 9/09716* (2013.01)

(58) Field of Classification Search
CPC ..... G03G 9/097; G03G 9/09725
See application file for complete search history.

(56) References Cited

U.S. PATENT DOCUMENTS 6,586,147 B2 7/2003 Iida et al.
6,929,894 B2 8/2005 Sugahara et al.
(Continued)

FOREIGN PATENT DOCUMENTS

JP 64-50059 A 2/1989
JP 2004-212740 A 7/2004
(Continued)

OTHER PUBLICATIONS

Terauchi, et al., U.S. Appl. No. 14/890,144, filed Nov. 9, 2015.
(Continued)

*Primary Examiner* — Hoa V Le
(74) *Attorney, Agent, or Firm* — Fitzpatrick Cella Harper and Scinto

(57) ABSTRACT

Provided is a toner, including: a toner particle; and an organic-inorganic composite fine particle on a surface of the toner particle, in which the organic-inorganic composite fine particle includes: a resin fine particle; and an inorganic fine particle embedded in the resin fine particle, and part of which is exposed to a surface of the composite fine particle, and in which the composite fine particle satisfies the following relationships: (i) in viscoelasticity measurement of the composite fine particle, when the loss elastic modulus thereof at a temperature T (° C.) is represented by $G''_T$ [dN/m$^2$], a change ratio d(Log($G''_T$))/dT of a common logarithm of the loss elastic modulus has a minimum in a temperature range of from 60° C. to 150° C., and the minimum is less than −0.10; and (ii) the loss elastic modulus ($G''_{180}$) thereof at a temperature of 180° C. is $1.0\times10^4$ dN/m$^2$ or more and $1.0\times10^7$ dN/m$^2$ or less.

8 Claims, 1 Drawing Sheet

(56) References Cited

U.S. PATENT DOCUMENTS

| | | | | |
|---|---|---|---|---|
| 7,147,980 | B2 | 12/2006 | Itakura et al. | |
| 7,351,509 | B2 | 4/2008 | Moribe et al. | |
| 7,700,254 | B2 | 4/2010 | Moribe et al. | |
| 7,740,998 | B2 | 6/2010 | Yamazaki et al. | |
| 7,855,042 | B2 | 12/2010 | Kobori et al. | |
| 9,034,549 | B2 | 5/2015 | Shiotari et al. | |
| 9,097,997 | B2 | 8/2015 | Nomura et al. | |
| 9,097,998 | B2 | 8/2015 | Yamazaki et al. | |
| 9,128,400 | B2 | 9/2015 | Takahashi et al. | |
| 9,201,323 | B2 * | 12/2015 | Nishikawa | G03G 9/09708 |
| 9,250,548 | B2 * | 2/2016 | Nomura | G03G 9/0838 |
| 2005/0089779 | A1 * | 4/2005 | Matsumoto | G03G 9/0827 430/45.51 |
| 2012/0052434 | A1 * | 3/2012 | Sugimoto | G03G 9/0806 430/108.8 |
| 2013/0252167 | A1 | 9/2013 | Moribe et al. | |
| 2014/0072910 | A1 * | 3/2014 | Iwatsuki | G03G 9/1131 430/111.1 |
| 2015/0037719 | A1 * | 2/2015 | Naka | G03G 9/0836 430/108.1 |
| 2015/0037721 | A1 * | 2/2015 | Nomura | G03G 9/0819 430/108.3 |
| 2015/0037723 | A1 * | 2/2015 | Nishikawa | G03G 9/09708 430/108.6 |
| 2015/0037726 | A1 * | 2/2015 | Nomura | G03G 9/0838 430/109.1 |
| 2015/0072287 | A1 * | 3/2015 | Amemori | G03G 9/08755 430/109.4 |
| 2015/0125790 | A1 | 5/2015 | Hotta et al. | |
| 2016/0041481 | A1 * | 2/2016 | Nomura | G03G 9/0825 430/110.3 |
| 2016/0041482 | A1 * | 2/2016 | Terauchi | G03G 9/0827 430/108.6 |
| 2016/0070192 | A1 * | 3/2016 | Terauchi | G03G 9/0819 430/106.2 |
| 2016/0179024 | A1 * | 6/2016 | Nishikawa | G03G 9/08755 430/108.7 |
| 2016/0202621 | A1 * | 7/2016 | Hotta | G03G 9/0823 430/110.3 |

FOREIGN PATENT DOCUMENTS

| | | | | |
|---|---|---|---|---|
| JP | 2005-202133 | A | 7/2005 | |
| JP | 2011-17913 | A | 1/2011 | |
| JP | 2013-92748 | A | 5/2013 | |
| WO | 2013/063291 | A1 | 5/2013 | |
| WO | WO 2013/063291 | * | 5/2013 | G03G 9/097 |

OTHER PUBLICATIONS

Yamazaki, et al., U.S. Appl. No. 14/900,590, filed Dec. 21, 2015.
Tsuda, et al., U.S. Appl. No. 14/892,575, filed Nov. 19, 2015.
Nishikawa, et al., U.S. Appl. No. 14/807,656, filed Jul. 23, 2015.
Nomura, et al., U.S. Appl. No. 14/814,873, filed Jul. 31, 2015.
Tsuda, et al., U.S. Appl. No. 14/812,793, filed Jul. 29, 2015.
Terauchi, et al., U.S. Appl. No. 14/817,201, filed Aug. 3, 2015.

* cited by examiner

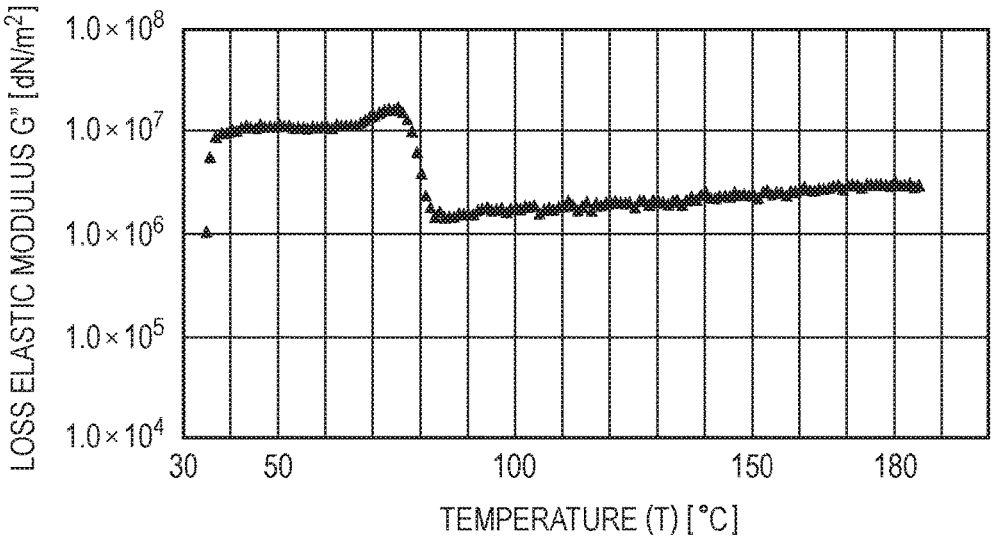
LOSS ELASTIC MODULUS G" [dN/m²]
1.0×10⁸
1.0×10⁷
1.0×10⁶
1.0×10⁵
1.0×10⁴
30
50
100
150
180
TEMPERATURE (T) [°C]

TONER AND EXTERNAL ADDITIVE FOR TONER

BACKGROUND OF THE INVENTION

Field of the Invention

The present invention relates to a toner to be used in an image-forming method, such as an electrophotographic method, and an external additive for a toner.

Description of the Related Art

An electrophotographic image-forming apparatus has been required to be additionally increased in speed and lifetime, and reduced in energy consumption, and a toner has been required to be additionally improved in various kinds of performance for corresponding to such requirements. In particular, the toner has been required to be additionally improved in low-temperature fixability from the viewpoints of the increase in speed and the energy savings. Meanwhile, various media have started to be used, and when large-size paper is passed after small-size paper has been passed, an end portion high-temperature offset may occur owing to an increase in temperature of an end portion of a fixing unit. Accordingly, not only the improvement in low-temperature fixability but also the maintenance of a high temperature-resistant offset property has started to become important.

Further, along with market expansion, the frequency at which the apparatus is used in a hot area typified by Southeast Asia or the Middle and Near East has been increasing. Accordingly, it has started to become important to maintain excellent developability even under high temperature on the assumption that the apparatus is used in such area.

Accordingly, various toners have been proposed for satisfying stable developability under high temperature, an additional improvement in low-temperature fixability, and a high temperature-resistant offset property.

Japanese Patent Application Laid-Open No. 2011-17913 proposes that low-temperature fixability can be improved by externally adding a crystalline resin fine particle to a toner particle.

SUMMARY OF THE INVENTION

The inventors of the present invention have made investigations on the toner described in Japanese Patent Application Laid-Open No. 2011-17913. As a result, the inventors have found that the toner according to Japanese Patent Application Laid-Open No. 2011-17913 is still susceptible to improvement in terms of developability, low-temperature fixability, and a high temperature-resistant offset property.

In view of the foregoing, an object of the present invention is to provide a toner and an external additive each of which is excellent in developability, low-temperature fixability, and high temperature-resistant offset property even under a high-speed condition.

The present invention relates to a toner, comprising: a toner particle; and an organic-inorganic composite fine particle on a surface of the toner particle, wherein the organic-inorganic composite fine particle comprises:

a resin fine particle; and an inorganic fine particle which is embedded in the resin fine particle, and part of which is exposed to a surface of the organic-inorganic composite fine particle, and wherein the organic-inorganic composite fine particle satisfies the following relationships (i) and (ii):

(i) in viscoelasticity measurement of the organic-inorganic composite fine particle, when a loss elastic modulus thereof at a temperature T (° C.) is represented by $G''_T$ [dN/m$^2$] and a change ratio of a common logarithm of the loss elastic modulus is represented by d(Log($G''_T$))/dT, the d(Log($G''_T$))/dT has a minimum in a temperature range of from 60° C. to 150° C., and the minimum is less than −0.10; and (ii) in the viscoelasticity measurement of the organic-inorganic composite fine particle, when a loss elastic modulus thereof at a temperature of 180° C. is represented by $G''_{180}$, the $G''_{180}$ is $1.0\times10^4$ dN/m$^2$ or more and $1.0\times10^7$ dN/m$^2$ or less.

The present invention also relates to an external additive for a toner, comprising an organic-inorganic composite fine particle comprising:

a resin fine particle, and an inorganic fine particle embedded in the resin fine particle, wherein a part of the inorganic fine particle is exposed to a surface of the organic-inorganic composite fine particle, and wherein the organic-inorganic composite fine particle satisfies the following relationships (i) and (ii):

(i) in viscoelasticity measurement of the organic-inorganic composite fine particle, when a loss elastic modulus thereof at a temperature T (° C.) is represented by $G''_T$ [dN/m$^2$] and a change ratio of a common logarithm of the loss elastic modulus is represented by d(Log($G''_T$))/dT, the d(Log($G''_T$))/dT has a minimum in a temperature range of from 60° C. to 150° C., and the minimum is less than −0.10; and (ii) in the viscoelasticity measurement of the organic-inorganic composite fine particle, when a loss elastic modulus thereof at a temperature of 180° C. is represented by ($G''_{180}$), the $G''_{180}$ is $1.0\times10^4$ dN/m$^2$ or more and $1.0\times10^7$ dN/m$^2$ or less.

Further features of the present invention will become apparent from the following description of exemplary embodiments with reference to the attached drawing.

BRIEF DESCRIPTION OF THE DRAWING

FIGURE is a graph of the loss elastic modulus (G") of organic-inorganic composite fine particles 1.

DESCRIPTION OF THE EMBODIMENTS

Preferred embodiments of the present invention will now be described in detail in accordance with the accompanying drawing.

As described in the foregoing, a toner has been required to satisfy developability, low-temperature fixability, and a high temperature-resistant offset property at additionally high levels even under a high-speed condition.

In ordinary cases, inorganic fine particles are externally added in a large amount for the maintenance of the developability of a toner in association with an increase in speed of a formation process for an electrophotographic image. Such toner may be poor in low-temperature fixability and high temperature-resistant offset property, though the toner has satisfactory developability. As described above, it has not been easy to obtain a toner that satisfies developability, low-temperature fixability, and a high temperature-resistant offset property at high levels.

Here, the inventors of the present invention have paid attention to a fixation process for a toner. The inventors have paid particular attention to the fact that in an electrophotographic apparatus having a high process speed for the formation of an electrophotographic image, it is for an extremely short time period that paper having laid thereon an unfixed toner can receive heat from a fixing unit at the time of heat fixation. In addition, the inventors have considered that how to melt the toner within the short heating time so that toner particles, and/or the toner and the paper, can be bonded to each other is important for an improvement in low-temperature fixability.

In view of the foregoing, the inventors of the present invention have considered that when a material that melts at low temperature is externally added to the surface of a toner particle, even within the short heating time, the surface of the toner can be melted, the toner particles, or the toner and the paper, can be bonded to each other, and hence the improvement in low-temperature fixability can be achieved. An attempt has been made to satisfy the low-temperature fixability and the high temperature-resistant offset property through the design of a binder resin, but in the electrophotographic apparatus having a high process speed, it is for an extremely short time period that the paper can receive heat from the fixing unit. Therefore, the inventors have considered that it is more effective to control the low-temperature fixability and the high temperature-resistant offset property with an external additive that melts at low temperature than with the binder resin.

However, when the low-melting point material is merely externally added to the toner particle, the low-melting point material is present on the toner surface to cause a reduction in chargeability of the toner and the adhesion of the low-melting point material to the toner carrier of a developing unit, and by extension, even a reduction in high temperature-resistant offset property may occur. It should be noted that the adhesion of the low-melting point material to the developer carrier reduces the ability of the developer carrier to provide the toner with charge, thereby causing a reduction in developability of the toner.

In view of the foregoing, the inventors of the present invention have given the external additive serving as the low-melting point material a twist for suppressing the reduction in high temperature-resistant offset property. The inventors have found that with such twist, compatibility among the developability, the low-temperature fixability, and the high temperature-resistant offset property can be achieved even under a high-speed condition.

Specifically, the inventors of the present invention have found that the use of a toner containing a toner particle, and an organic-inorganic composite fine particle present on the surface of the toner particle and having the following characteristics simultaneously satisfies the developability, the low-temperature fixability, and the high temperature-resistant offset property at high levels. The organic-inorganic composite fine particle contains a resin fine particle and an inorganic fine particle embedded in the resin fine particle, part of the inorganic fine particle is exposed to the surface of the organic-inorganic composite fine particle, and the organic-inorganic composite fine particle is characterized by satisfying the following relationships (i) and (ii):

(i) in viscoelasticity measurement of the organic-inorganic composite fine particle, when the loss elastic modulus thereof at a temperature T (° C.) is represented by $G''_T$ [dN/m$^2$] and a change ratio of a common logarithm of the loss elastic modulus is represented by $d(Log(G''_T))/dT$, the $d(Log(G''_T))/dT$ has a minimum in a temperature range of from 60° C. to 150° C., and the minimum is less than −0.10; and (ii) in the viscoelasticity measurement of the organic-inorganic composite fine particle, when the loss elastic modulus thereof at a temperature of 180° C. is represented by $G''_{180}$, the $G''_{180}$ is $1.0\times10^4$ dN/m$^2$ or more and $1.0\times10^7$ dN/m$^2$ or less.

With regard to the low-temperature fixability, it is important to control the change ratio $d(Log(G''_T))/dT$ of the common logarithm of the loss elastic modulus of the organic-inorganic composite fine particle. As a value for the change ratio $d(Log(G''_T))/dT$ becomes smaller than 0, in other words, the gradient becomes smaller than 0, the loss elastic modulus $G''_T$ abruptly reduces. The expression the loss elastic modulus $G''_T$ abruptly reduces" means that the organic-inorganic composite fine particle instantaneously melts at the temperature T.

The expression the change ratio $d(Log(G''_T))/dT$ of the common logarithm of the loss elastic modulus of the organic-inorganic composite fine particle has a minimum in the temperature range of from 60° C. to 150° C." means that the point at which a change in the loss elastic modulus $G''_T$ with temperature becomes largest is present. In other words, the expression means that the point at which the gradient becomes smallest is present in the range of from 60° C. to 150° C. In consideration of heat which the toner receives from a fixing unit at the time of its low-temperature fixation, it is important that the change ratio has the minimum in the temperature range of from 60° C. to 150° C.

When the minimum of the change ratio $d(Log(G''_T))/dT$ of the common logarithm of the loss elastic modulus in the temperature range of from 60° C. to 150° C. is less than −0.10, the organic-inorganic composite fine particle melts by the heat which the fine particle has received from the fixing unit within a short time period. In addition, when the organic-inorganic composite fine particle present on the toner surface melts within a short time period, the toner particles, or the toner and paper, can be quickly bonded to each other, and hence the low-temperature fixability improves.

When the temperature at which the change ratio $d(Log(G''_T))/dT$ of the common logarithm of the loss elastic modulus has the minimum is less than 60° C., the developability is liable to reduce. In addition, when the temperature is more than 150° C., an improving effect on the low-temperature fixability is hardly obtained.

When the minimum of the change ratio $d(Log(G''_T))/dT$ of the common logarithm of the loss elastic modulus in the temperature range of from 60° C. to 150° C. is more than −0.10, it becomes difficult to melt the organic-inorganic composite fine particle with the heat from the fixing unit within a short time period, and hence it becomes difficult to obtain the improving effect on the low-temperature fixability.

With regard to the high temperature-resistant offset property, it is important to control the loss elastic modulus $G''_{180}$ at a temperature of 180° C. As the loss elastic modulus $G''_{180}$ becomes larger, the organic-inorganic composite fine particle has higher elastic modulus even when the fine particle receives heat. In the case where the organic-inorganic composite fine particle has elastic modulus, even when the temperature of a fixing roller is high, the organic-inorganic composite fine particle is excellent in releasability from the fixing roller. As a result, releasability between the toner having externally added thereto the organic-inorganic composite fine particle and the fixing roller also improves, and hence a high-temperature offset hardly occurs.

When the loss elastic modulus $G''_{180}$ of the organic-inorganic composite fine particle at a temperature of 180° C.

is $1.0\times10^4$ dN/m$^2$ or more and $1.0\times10^7$ dN/m$^2$ or less, the high temperature-resistant offset property improves. The inventors have assumed that this is because the organic-inorganic composite fine particle is excellent in releasability from the fixing roller even when the temperature of the fixing roller becomes a high temperature at which the high-temperature offset is liable to occur.

When the loss elastic modulus $G''_{180}$ at a temperature of 180° C. is less than $1.0\times10^4$ dN/m$^2$, the high temperature-resistant offset property is liable to deteriorate. In addition, when the loss elastic modulus is more than $1.0\times10^7$ dN/m$^2$, the organic-inorganic composite fine particle hardly undergoes an elastic deformation at the time of fixation, and hence its releasability from the fixing roller becomes insufficient. Accordingly, the fine particle contaminates the fixing roller and hence an offset is liable to occur.

The organic-inorganic composite fine particle according to the present invention contains the resin fine particle and the inorganic fine particle embedded in the surface of the resin fine particle, and part of the inorganic fine particle is exposed to the surface of the organic-inorganic composite fine particle. When the organic-inorganic composite fine particle has a structure in which the inorganic fine particle is embedded in the resin fine particle, the strength of the resin fine particle can easily increase. As a result, the loss elastic modulus $G''_{180}$ at a temperature of 180° C. can be set to $1.0\times10^4$ dN/m$^2$ or more and $1.0\times10^7$ dN/m$^2$ or less. In addition, when the inorganic fine particle is embedded in the resin fine particle, the chargeability of the organic-inorganic composite fine particle can be easily improved, and hence the developability of the toner can be improved.

Further, according to such organic-inorganic composite fine particle, opportunities for direct contact between the resin fine particle and the developer carrier can be reduced, and hence the adhesion of a resin constituting the resin fine particle to the surface of the developer carrier can be suppressed. As a result, the reduction in developability can be suppressed.

When the resin fine particle and the inorganic fine particle are not composited with each other, and only the resin fine particle portion is used as an external additive, a desired elastic characteristic is not obtained and hence the high temperature-resistant offset property is liable to deteriorate. In addition, the chargeability deteriorates and hence the developability is liable to reduce. When the resin fine particle and the inorganic fine particle are not composited with each other, and only the inorganic fine particle portion is used as the external additive, both an improvement in low-temperature fixability and the suppression of the high-temperature offset become difficult.

As described above, the use of the organic-inorganic composite fine particle as the external additive is effective for the developability, the low-temperature fixability, and the high temperature-resistant offset property under a high-speed condition.

A known method can be used as a method of obtaining the organic-inorganic composite fine particle according to the present invention.

For example, in a method involving driving the inorganic fine particle in the resin fine particle to produce the organic-inorganic composite fine particle, first, the resin fine particle is produced. A method of producing the resin fine particle is, for example, a method involving freezing and pulverizing the resin to turn the resin into a fine particle, or a method involving dissolving the resin in a solvent and subjecting the solution to phase-transfer emulsification to provide the resin fine particle. In addition, Hybridizer (manufactured by Nara Machinery Co., Ltd.), Nobilta (manufactured by Hosokawa Micron Corporation), Mechanofusion (manufactured by Hosokawa Micron Corporation), High Flex Gral (manufactured by Earthtechnica Co., Ltd.), or the like can be used in the method involving driving the inorganic fine particle in the resultant resin fine particle. When the resin fine particle and the inorganic fine particle are treated with any such apparatus, the inorganic fine particle can be embedded in the surface of the resin fine particle and hence the organic-inorganic composite fine particle can be produced.

In addition, the organic-inorganic composite fine particle can be produced by producing the resin fine particle through emulsion polymerization in the presence of the inorganic fine particle. In addition, the organic-inorganic composite fine particle having the structure in which the inorganic fine particle is embedded in the resin fine particle can be produced by a method involving dissolving the resin in an organic solvent, adding the inorganic fine particle to the solution, and performing phase-transfer emulsification under this state.

When the inorganic fine particle is further externally added under a state in which only the resin fine particle is externally added to the toner, or when the resin fine particle and the inorganic fine particle are externally added at the same time, the inorganic fine particle is liable to merely adhere onto the resin fine particle. Accordingly, its embedding in the resin fine particle is often insufficient and hence the effects of the present invention are hardly obtained.

For example, tetrahydrofuran (THF), toluene, ethyl acetate, acetone, methyl ethyl ketone, or hexane can be used as the organic solvent for dissolving the resin.

When the resin fine particle and the inorganic fine particle are externally added at the same time, or when the resin fine particle and the inorganic fine particle are externally added in order, the resin fine particle and the inorganic fine particle may, for example, agglomerate on the toner particle to apparently become an integrated organic-inorganic composite fine particle. In the method, however, uniformity between the resin fine particle and the inorganic fine particle is insufficient, or the embedding of the inorganic fine particle in the resin fine particle is insufficient in many cases, and hence the effects of the present invention are hardly obtained.

Examples of the inorganic fine particle constituting the organic-inorganic composite fine particle according to the present invention can include a silica fine particle, an alumina fine particle, a titania fine particle, a zinc oxide fine particle, a strontium titanate fine particle, a cerium oxide fine particle, and a calcium carbonate fine particle. An arbitrary combination of two or more kinds selected from the group of fine particles can also be used.

A toner according to the present invention obtained by externally adding the organic-inorganic composite fine particle using the silica fine particle as the inorganic fine particle is particularly preferred because the toner has particularly excellent chargeability. A fine particle obtained by a dry method like fumed silica may be used as the silica fine particle, or a fine particle obtained by a wet method like a sol-gel method may also be used.

The number average particle diameter of the primary particles of the inorganic fine particles is preferably 5 nm or more and 100 nm or less. When the number average particle diameter of the primary particles of the inorganic fine particles is 5 nm or more and 100 nm or less, the surface of the resin fine particle can be easily covered and hence the contamination of the developer carrier is suppressed, which is effective for the developability.

The kind of the resin of the resin fine particle is not particularly limited as long as the organic-inorganic composite fine particle according to the present invention can have a predetermined loss elastic modulus. However, a crystalline polyester is preferably incorporated into the resin fine particle for additionally improving the low-temperature fixability.

When the crystalline polyester is incorporated into the resin fine particle, the crystalline polyester is obtained by the polycondensation of a diol component and an acid (dicarboxylic acid) component. As an aliphatic diol that can be used in the synthesis of the crystalline polyester, for example, there can be given 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,20-eicosanediol; and the like. Each of those diols may be used alone, or two or more kinds thereof may be used as a mixture. It should be noted that the aliphatic diol according to the present invention is not limited thereto.

In addition, an aliphatic diol having a double bond can also be used as the aliphatic diol. Examples of the aliphatic diol having a double bond can include the following diols: 2-butene-1,4-diol, 3-hexene-1,6-diol, and 4-octene-1,8-diol.

Next, the acid component that can be used in the synthesis of the crystalline polyester is described.

A polyvalent carboxylic acid is preferred as the acid component that can be used in the synthesis of the crystalline polyester.

As an aliphatic dicarboxylic acid, for example, there can be given oxalic acid, malonic acid, succinic acid, glutaric acid, adipic acid, pimelic acid, suberic acid, azelaic acid, sebacic acid, 1,9-nonanedicarboxylic acid, 1,10-decanedicarboxylic acid, 1,11-undecanedicarboxylic acid, 1,12-dodecanedicarboxylic acid, 1,13-tridecanedicarboxylic acid, 1,14-tetradecanedicarboxylic acid, 1,16-hexadecanedicarboxylic acid, and 1,18-octadecanedicarboxylic acid, and lower alkyl esters and acid anhydrides thereof. Of those, sebacic acid, adipic acid, and 1,10-decanedicarboxylic acid, and lower alkyl esters and acid anhydrides thereof are preferred. One kind of those compounds may be used alone, or two or more kinds thereof may be used as a mixture. In addition, the aliphatic dicarboxylic acid is not limited thereto.

As an aromatic dicarboxylic acid, for example, there can be given terephthalic acid, isophthalic acid, 2,6-naphthalenedicarboxylic acid, and 4,4'-biphenyldicarboxylic acid. Of those, terephthalic acid is preferred from the viewpoints of the ease of availability and the ease with which a polymer having a low melting point is formed.

In addition, as the acid component, a dicarboxylic acid having a double bond can be used. Examples of such dicarboxylic acid include fumaric acid, maleic acid, 3-hexenedioic acid, and 3-octenedioic acid. In addition, lower alkyl esters and acid anhydrides thereof can also be used. Of those, fumaric acid and maleic acid are preferred from the viewpoint of cost.

A method of producing the crystalline polyester is not particularly limited, and the crystalline polyester can be produced by a general polyester polymerization method involving causing an acid component and an alcohol component to react with each other. For example, the crystalline polyester can be produced by appropriately using a direct polycondensation method and an ester exchange method depending on the kinds of the monomers.

The production of the crystalline polyester is preferably performed at a polymerization temperature of from 180° C. to 230° C., and the monomers are preferably caused to react with each other under a state in which a pressure in a reaction system is reduced as required while water and an alcohol to be produced at the time of condensation are removed.

When the monomers do not dissolve or are not compatible with each other under the reaction temperature, a high-boiling point solvent is desirably added as a solubilizing aid to dissolve the monomers. A polycondensation reaction is performed while the solvent serving as a solubilizing aid is distilled off. When a monomer having poor compatibility is present in a copolymerization reaction, the monomer having poor compatibility and an acid or alcohol to be subjected to polycondensation with the monomer are preferably condensed in advance before being subjected to the polycondensation together with a main component.

For example, a titanium catalyst or a tin catalyst can be given as a catalyst that can be used in the production of the crystalline polyester.

Examples of the titanium catalyst include titanium tetraethoxide, titanium tetrapropoxide, titanium tetraisopropoxide, and titanium tetrabutoxide. In addition, examples of the tin catalyst include dibutyltin dichloride, dibutyltin oxide, and diphenyltin oxide.

The surface of the organic-inorganic composite fine particle according to the present invention is preferably treated with an organosilicon compound or a silicone oil. When the surface is treated with the organosilicon compound or the silicone oil, the hydrophobicity of the external additive can be improved, and hence a toner having stable developability even in a high-temperature and high-humidity environment can be obtained.

Examples of a method of producing the external additive subjected to the surface treatment with the organosilicon compound or the silicone oil include a method involving subjecting the organic-inorganic composite fine particle to the surface treatment, and a method involving compositing the inorganic fine particle subjected to the surface treatment with the organosilicon compound or the silicone oil in advance with the resin.

The organic-inorganic composite fine particle or the inorganic fine particle to be used in the organic-inorganic composite fine particle can be hydrophobized by a chemical treatment with an organosilicon compound that reacts with, or physically adsorbs to, the organic-inorganic composite fine particle or the inorganic fine particle.

A preferred method involves treating a silica fine particle produced by the vapor-phase oxidation of a silicon halide with the organosilicon compound. Examples of the organosilicon compound include the following compounds: hexamethyldisilazane, methyltrimethoxysilane, octyltrimethoxysilane, isobutyltrimethoxysilane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, a triorganosilylmercaptan, trimethylsilylmercaptan, a triorganosilyl acrylate, vinyldimethylacetoxysilane, dimethylethoxysilane, dimethyldimethoxysilane, diphenyldiethoxysilane, 1-hexamethyldisiloxane, 1,3-divinyltetramethyldisiloxane, 1,3-diphenyltetramethyldisiloxane, and a dimethylpolysiloxane having 2 to 12 siloxane units per molecule and containing one hydroxyl group bonded to Si in each unit positioned at an end. One kind of those compounds may be used alone, or two or more kinds thereof may be used as a mixture.

The organic-inorganic composite fine particle or the inorganic fine particle to be used in the organic-inorganic composite fine particle may be treated with a silicone oil, or may be subjected to both the hydrophobic treatment and the silicone oil treatment.

The silicone oil to be used is preferably one having a viscosity at 25° C. of 30 $mm^2/s$ or more and 1,000 $mm^2/s$ or less. Specific examples of such silicone oil include a dimethyl silicone oil, a methyl phenyl silicone oil, an α-methylstyrene-modified silicone oil, a chlorophenyl silicone oil, and a fluorine-modified silicone oil.

As a method for the silicone oil treatment, there is given, for example: a method involving directly mixing silane coupling agent-treated silica fine particles and the silicone oil through the use of a mixing machine, such as a Henschel mixer; a method involving spraying the silica fine particles serving as a base with the silicone oil; or a more preferred method involving dissolving or dispersing the silicone oil in an appropriate solvent, and then adding and mixing the silica fine particles, followed by the removal of the solvent.

The number average particle diameter of the primary particles of the organic-inorganic composite fine particles according to the present invention is preferably nm or more and 500 nm or less. A number average particle diameter of the primary particles of 30 nm or more and 500 nm or less is preferred for the melting of the organic-inorganic composite fine particles themselves at the time of their reception of the heat from the fixing unit, and is effective for the low-temperature fixability because the toner particles, or the toner and the paper, can be strongly bonded to each other. In addition, such number average particle diameter is effective for the maintenance of the developability. In addition, such number average particle diameter exhibits an effect on the high temperature-resistant offset property because the organic-inorganic composite fine particles each become excellent in releasability from the fixing roller.

The addition amount of the inorganic fine particle in the organic-inorganic composite fine particle according to the present invention is preferably 10 parts by mass or more and 80 parts by mass or less with respect to 100 parts by mass of the organic-inorganic composite fine particle in order that the effects of the present invention may be obtained.

The toner according to the present invention may contain any other external additive except the organic-inorganic composite fine particle. In particular, a flowability improver may be added as the other external additive for improving the flowability and chargeability of the toner.

Any one of the following materials can be used as the flowability improver:

fluorine-based resin powder, such as vinylidene fluoride fine powder and polytetrafluoroethylene fine powder; fine powder silica, such as wet process silica or dry process silica, fine powder titanium oxide, fine powder alumina, and treated silica obtained by subjecting the fine powder silica, the fine powder titanium oxide, or the fine powder alumina to surface treatment with a silane compound, a titanium coupling agent, or a silicone oil; oxides, such as zinc oxide and tin oxide; complex oxides, such as strontium titanate, barium titanate, calcium titanate, strontium zirconate, and calcium zirconate; carbonate compounds, such as calcium carbonate and magnesium carbonate; and the like.

A preferred flowability improver is fine powder produced by the vapor-phase oxidation of a silicon halide, i.e., the so-called dry method silica or fumed silica. Such silica is, for example, silica obtained by utilizing the thermal decomposition oxidation reaction of a silicon tetrachloride gas in an oxyhydrogen flame, and a reaction formula that forms a basis for the reaction is as described below.

$$SiCl_4+2H_2+O_2 \rightarrow SiO_2+4HCl$$

In the production process, a composite fine powder of the silica and any other metal oxide can be obtained by using any other metal halide, such as aluminum chloride or titanium chloride, together with the silicon halide, and such fine powder is also included in the silica.

The number average particle diameter of the primary particles of the flowability improver is preferably 5 nm or more and 30 nm or less because high chargeability and high flowability can be imparted to the toner.

Further, the flowability improver to be used in the present invention is more preferably treated silica fine powder obtained by subjecting the silica fine powder produced by the gas-phase oxidation of the silicon halide to a hydrophobic treatment. The same method as that for the surface treatment of the organic-inorganic composite fine particle or the inorganic fine particle to be used in the organic-inorganic composite fine particle can be used for the hydrophobic treatment.

The flowability improver preferably has a specific surface area based on nitrogen adsorption measured by a BET method of 30 $m^2/g$ or more and 300 $m^2/g$ or less.

The flowability improver is preferably used in a total amount of 0.01 part by mass or more and 3 parts by mass or less with respect to 100 parts by mass of the toner particle.

The toner of the present invention can be used as a one-component developer, and can be used as a two-component developer by being used in combination with a carrier. All conventionally known carriers can each be used as the carrier in the case where the toner is used in a two-component developing method. Specifically, surface-oxidized or unoxidized metals, such as iron, nickel, cobalt, manganese, chromium, and rare earths, and alloys or oxides thereof are each preferably used.

In addition, a carrier obtained by forming a coating layer on the surface of a carrier core particle with the following resin is preferably used: a styrene-based resin, an acrylic resin, a silicone-based resin, a fluorine-based resin, a polyester resin, or the like.

Next, the toner particle according to the present invention is described.

First, a binder resin to be used in the toner particle according to the present invention is described.

Examples of the binder resin include a polyester-based resin, a vinyl-based resin, an epoxy resin, and a polyurethane resin. Of those, a polyester resin that generally has high polarity is particularly preferably incorporated into the toner particle in terms of the developability from the viewpoint that a charge control agent having polarity is uniformly dispersed.

The glass transition temperature (Tg) of the binder resin is preferably 30° C. or more and 70° C. or less from the viewpoint of the storage stability of the toner.

The toner according to the present invention may be used as a magnetic toner by further incorporating magnetic particles into the toner. In this case, the magnetic particles can each also serve as a colorant.

In the present invention, as magnetic iron oxide particles to be incorporated into the magnetic toner, there are given: iron oxides such as magnetite, hematite, and ferrite; and metals such as iron, cobalt, and nickel, alloys of these metals with metals such as aluminum, cobalt, copper, lead, magnesium, tin, zinc, antimony, bismuth, calcium, manganese, titanium, tungsten, and vanadium, and mixtures thereof.

Such magnetic particles have an average particle diameter of preferably 2 μm or less. The magnetic particles are incorporated into the toner in an amount of preferably 20 parts by mass or more and 200 parts by mass or less with respect to 100 parts by mass of the binder resin.

A colorant to be used in the present invention is exemplified below.

For example, a colorant toned to black by using carbon black, grafted carbon, or the following yellow/magenta/cyan colorant can be utilized as a black colorant. As a yellow colorant, there are given, for example, compounds typified by a condensed azo compound, an isoindolinone compound, an anthraquinone compound, an azo metal complex, a methine compound, and an allylamide compound. As a magenta colorant, there are given, for example, a condensed azo compound, a diketopyrrolopyrrole compound, anthraquinone, a quinacridone compound, a basic dye lake compound, a naphthol compound, a benzimidazolone compound, a thioindigo compound, and a perylene compound. As a cyan colorant, there are given, for example, a copper phthalocyanine compound and a derivative thereof, an anthraquinone compound, and a basic dye lake compound. One kind of those colorants may be used alone, or two or more kinds thereof may be used as a mixture as well as in a solid solution state.

The colorant is selected in terms of a hue angle, chroma, brightness, weatherability, OHP transparency, and dispersibility in the toner. The addition amount of the colorant is 1 part by mass or more and 20 parts by mass or less with respect to 100 parts by mass of the binder resin.

The toner according to the present invention may further contain a wax. Specific examples of the wax include:

- aliphatic hydrocarbon-based waxes, such as low-molecular-weight polyethylene, low-molecular-weight polypropylene, a polyolefin copolymer, a polyolefin wax, a microcrystalline wax, a paraffin wax, and a Fischer-Tropsch wax;
- oxides of aliphatic hydrocarbon-based waxes, such as a polyethylene oxide wax; or block copolymers thereof;
- plant-based waxes, such as a candelilla wax, a carnauba wax, a haze wax, and a jojoba wax;
- animal-based waxes, such as a bees wax, lanolin, and a spermaceti wax;
- mineral-based waxes, such as ozokerite, ceresin, and petrolatum;
- waxes containing aliphatic esters as main components, such as a montanic acid ester wax and a castor wax; and
- partially or wholly deoxidized aliphatic esters, such as a deoxidized carnauba wax.

The examples further include: saturated linear fatty acids, such as palmitic acid, stearic acid, montanic acid, and a long-chain alkylcarboxylic acid having an additionally long alkyl group; unsaturated fatty acids, such as brassidic acid, eleostearic acid, and parinaric acid; saturated alcohols, such as stearyl alcohol, eicosyl alcohol, behenyl alcohol, carnaubyl alcohol, ceryl alcohol, melissyl alcohol, and an alkyl alcohol having an additionally long alkyl group; polyhydric alcohols, such as sorbitol; fatty acid amides, such as linoleamide, oleamide, and lauramide; saturated fatty acid bis amides, such as methylene bis stearamide, ethylene bis capramide, ethylene bis lauramide, and hexamethylene bis stearamide; unsaturated fatty acid amides, such as ethylene bis oleamide, hexamethylene bis oleamide, N,N'-dioleyl adipamide, and N,N'-dioleyl sebacamide; aromatic bis amides, such as m-xylene bis stearamide and N,N'-distearyl isophthalamide; aliphatic metal salts (which are generally referred to as metallic soaps), such as calcium stearate, calcium laurate, zinc stearate, and magnesium stearate; waxes obtained by grafting aliphatic hydrocarbon-based waxes with vinyl-based monomers, such as styrene and acrylic acid; partially esterified products of fatty acids and polyhydric alcohols, such as behenic monoglyceride; and methyl ester compounds each having a hydroxyl group obtained by hydrogenation of vegetable oils and fats.

In addition, the waxes whose molecular weight distribution is sharpened by a press sweating method, a solvent method, a recrystallization method, a vacuum distillation method, a supercritical gas extraction method, or a melt crystallization method can be suitably used. Further, waxes from which a low-molecular-weight solid fatty acid, a low-molecular-weight solid alcohol, a low-molecular-weight solid compound, or other impurities are removed can also be suitably used.

Specific examples of the waxes that can be used as release agents include: Biscol (trademark) 330-P, 550-P, 660-P, and TS-200 (Sanyo Chemical Industries, Ltd.); HI-WAX 400P, 200P, 100P, 410P, 420P, 320P, 220P, 210P, and 110P (Mitsui Chemicals, Inc.); Sasol H1, H2, C80, C105, and C77 (Schumann Sasol); HNP-1, HNP-3, HNP-9, HNP-10, HNP-11, and HNP-12 (Nippon Seiro Co., Ltd.); Unilin (trademark) 350, 425, 550, and 700 and Unisid (trademark) 350, 425, 550, and 700 (Toyo-Petrolite); and a haze wax, a beeswax, a rice wax, a candelilla wax, and a carnauba wax (available from Cerarica Noda Co., Ltd.).

A charge control agent is preferably used in the toner according to the present invention for stabilizing its chargeability. Useful as such charge control agent is an organometallic complex or chelate compound whose central metal can easily interact with an acid group or hydroxyl group present at a terminal of the binder resin to be used in the present invention. Examples thereof include: a monoazo metal complex; an acetylacetone metal complex; and a metal complex or metal salt of an aromatic hydroxycarboxylic acid or an aromatic dicarboxylic acid.

Specific examples of the charge control agent that can be used include Spilon Black TRH, T-77, and T-95 (manufactured by Hodogaya Chemical Co., Ltd.), and BONTRON (trademark) S-34, S-44, S-54, E-84, E-88, and E-89 (manufactured by Orient Chemical Industries Co., Ltd.). In addition, a charge control resin can also be used in combination with the charge control agent.

A method of producing the toner particle according to the present invention is not particularly limited, and for example, a pulverization method and the so-called polymerization methods, such as an emulsion polymerization method, a suspension polymerization method, and a dissolution suspension method, can each be used.

In the pulverization method, first, the binder resin, the colorant, the wax, the charge control agent, and the like constituting the toner particle are sufficiently mixed with a mixer, such as a Henschel mixer or a ball mill. Next, the resultant mixture is melted and kneaded with a heat kneader, such as a biaxial kneading extruder, a heat roll, a kneader, or an extruder, and is cooled to be solidified, followed by pulverization and classification. Thus, the toner particle according to the present invention is obtained.

Further, the toner particle is sufficiently mixed with a desired external additive as required with a mixer, such as a Henschel mixer. Thus, the toner according to the present invention can be obtained.

Examples of the mixer include: Henschel mixer (manufactured by Mitsui Mining Co., Ltd.); Super Mixer (manufactured by Kawata Mfg. Co., Ltd.); Ribocone (manufactured by Okawara Mfg. Co., Ltd.); Nauta Mixer, Turburizer, and Cyclomix (manufactured by Hosokawa Micron Corporation); Spiral Pin Mixer (manufactured by Pacific Machinery & Engineering Co., Ltd.); and Loedige Mixer (manufactured by Matsubo Corporation).

Examples of the kneader include: KRC Kneader (manufactured by Kurimoto, Ltd.); Buss Ko-Kneader (manufactured by Buss); TEM-type extruder (manufactured by Toshiba Machine Co., Ltd.); TEX twin screw kneader (manufactured by The Japan Steel Works, Ltd.); PCM extruder (manufactured by Ikegai Ironworks Corp); THREE ROLL MILL, MIXING ROLL MILL, and Kneader (manufactured by Inoue Mfg., Inc.); KNEADEX (manufactured by Mitsui Mining Co., Ltd.); MS TYPE DISPERSION MIXER and KNEADER-RUDER (manufactured by Moriyama Company Ltd.); and Banbury mixer (manufactured by Kobe Steel, Ltd.).

Examples of the pulverizer include: Counter Jet Mill, Micron Jet, and Inomizer (manufactured by Hosokawa Micron Corporation); IDS-type Mill and PJM Jet Mill (manufactured by Nippon Pneumatic Mfg. Co., Ltd.); Cross Jet Mill (manufactured by Kurimoto, Ltd.); ULMAX (manufactured by Nisso Engineering Co., Ltd.); SK Jet-O-Mill (manufactured by Seishin Enterprise Co., Ltd.); Criptron (manufactured by Kawasaki Heavy Industries, Ltd.); Turbo Mill (manufactured by Turbo Kogyo Co., Ltd.); and Super Rotor (manufactured by Nisshin Engineering Inc.).

Examples of the classifier include: Classiel, Micron Classifier, and Spedic Classifier (manufactured by Seishin Enterprise Co., Ltd.); Turbo Classifier (manufactured by Nisshin Engineering Inc.); Micron Separator, Turboprex (ATP), and TSP Separator (manufactured by Hosokawa Micron Corporation); Elbow Jet (manufactured by Nittetsu Mining Co., Ltd.); Dispersion Separator (manufactured by Nippon Pneumatic Mfg. Co., Ltd.); and YM Microcut (manufactured by Yasukawa Shoji K.K.).

The measurement of various physical properties according to the toner of the present invention is described below.

In the case of the toner having externally added thereto the organic-inorganic composite fine particle, when the physical properties of the organic-inorganic composite fine particle are measured, the measurement can be performed by separating the organic-inorganic composite fine particle from the toner. The organic-inorganic composite fine particle is removed by subjecting the toner to ultrasonic dispersion in methanol, and the resultant is left at rest for 24 hours. The precipitated toner particle and the organic-inorganic composite fine particle dispersed in a supernatant are separated from each other and recovered, and are sufficiently dried. Thus, the toner particle and the organic-inorganic composite fine particle can be isolated from each other.

<Method of Measuring Loss Elastic Modulus (G") of Organic-inorganic Composite Fine Particle>

The loss elastic modulus (G") of the resin of the organic-inorganic composite fine particle is measured with a rotary plate-type rheometer "ARES" (manufactured by TA Instruments).

Used as a measurement sample is a sample obtained by pressure-molding the toner (pressing at 15 kN and normal temperature for 1 minute) into a disc shape having a diameter of 7.9 mm and a thickness of 2.0±0.3 mm under an environment having a temperature of 25° C. with a tablet molding machine.

The sample is mounted on a parallel plate, and the shape of the sample is adjusted by increasing its temperature from room temperature (25° C.) to 120° C. in 15 minutes. After that, the sample is cooled to the temperature at which the measurement of its viscoelasticity is started, and then the measurement is started. At this time, it is important that the sample be set so that an initial normal force may be 0. In addition, as described below, in subsequent measurement, an influence of the normal force can be cancelled by turning the Auto Tension Adjustment ON.

The measurement is performed under the following conditions.

(1) A parallel plate having a diameter of 7.9 mm is used.
(2) The Frequency is set to 6.28 rad/sec.
(3) The Strain is set to 0.1%.
(4) The measurement is performed in the range of from 35° C. to 185° C. at a Ramp Rate of 2.0° C./min. It should be noted that the measurement is performed under the preset conditions of the following auto adjustment mode. The measurement is performed according to the Auto Strain mode. Viscoelasticity data is measured every 30 seconds, i.e., every 1° C.
(5) The Max Applied Strain is set to 20.0%.
(6) The Max Allowed Torque is set to 200.0 g·cm and the Min Allowed Torque is set to 0.2 g·cm.
(7) The Strain Adjustment is set to 20.0% of Current Strain. In the measurement, the Auto Tension mode is adopted.
(8) The Auto Tension Direction is set to Compression.
(9) The Initial Static Force is set to 10.0 g and the Auto Tension Sensitivity is set to 40.0 g.
(10) An operating condition for the Auto Tension is that the Sample Modulus is $1.0\times10^3$ (Pa) or more.

A loss elastic modulus (G") curve with respect to a temperature (T) is obtained by the measurement. Based on the resultant loss elastic modulus (G") curve, when a loss elastic modulus at the temperature (T) is represented by $(G''_T)$, the change ratio $d(\mathrm{Log}(G''_T))/dT$ of the common logarithm $(\mathrm{Log}(G''_T))$ of the loss elastic modulus $(G''_T)$ is determined as described below.

First, a gradient Δ1 between pieces of measured data at two adjacent points (T−1.0, T+1.0) in front of and behind the measurement temperature T is determined.

$$\Delta 1=\{\mathrm{Log}(G''_{T+1.0})-\mathrm{Log}(G''_{T-1.0})\}/\{(T+1.0)-(T-1.0)\}=\{\mathrm{Log}(G''_{T+1.0})-\mathrm{Log}(G''_{T-1.0})\}/2.0$$

The Δ1 is defined as data on the change ratio $d(\mathrm{Log}(G''_T))/dT$ at the temperature (T).

When the loss elastic modulus (G") becomes lower than $1.0\times10^3$ dN/m$^2$ during the measurement, the measurement is ended at the time point. Any other external additive is subjected to measurement by the same method.

<Method of Measuring Number Average Particle Diameter of Primary Particles of Organic-inorganic Composite Fine Particles>

The number average particle diameter of the primary particles of the organic-inorganic composite fine particles is measured with a scanning electron microscope "S-4800" (trade name; manufactured by Hitachi, Ltd.). The toner having externally added thereto the organic-inorganic composite fine particles is observed, the long diameters of 100 randomly selected primary particles of the organic-inorganic composite fine particles are measured in a field of view magnified by a factor of up to 200,000, and their number average particle diameter is determined. The observation magnification is appropriately adjusted in accordance with the sizes of the organic-inorganic composite fine particles. Any other external additive is subjected to measurement by the same method.

<Method of Measuring Weight Average Particle Diameter (D4) of Toner>

The weight average particle diameter (D4) of the toner is calculated as described below. A precision particle size distribution measuring apparatus based on a pore electrical resistance method provided with a 100-μm aperture tube "Coulter Counter Multisizer 3" (trademark, manufactured by Beckman Coulter, Inc.) is used as a measuring apparatus. Dedicated software included with the apparatus "Beckman Coulter Multisizer 3 Version 3.51" (manufactured by Beckman Coulter, Inc.) is used for setting measurement conditions and analyzing measurement data. It should be noted that the measurement is performed at a number of effective measurement channels of 25,000.

An electrolyte aqueous solution prepared by dissolving reagent grade sodium chloride in ion-exchanged water so as to have a concentration of about 1 mass %, for example, "ISOTON II" (manufactured by Beckman Coulter, Inc.) can be used in the measurement.

It should be noted that the dedicated software was set as described below prior to the measurement and the analysis.

In the "Change Standard Operating Method (SOM)" screen of the dedicated software, the total count number of a control mode is set to 50,000 particles, the number of times of measurement is set to 1, and a value obtained by using "standard particles each having a particle diameter of 10.0 μm" (manufactured by Beckman Coulter, Inc.) is set as a Kd value. A threshold and a noise level are automatically set by pressing a "Threshold/Measure Noise Level button". In addition, a current is set to 1,600 μA, a gain is set to 2, and an electrolyte solution is set to ISOTON II, and a check mark is placed in a check box "Flush Aperture Tube after Each Run."

In the "Convert Pulses to Size Settings" screen of the dedicated software, a bin spacing is set to a logarithmic particle diameter, the number of particle diameter bins is set to 256, and a particle diameter range is set to the range of from 2 μm to 60 μm.

A specific measurement method is as described below.

(1) About 200 mL of the electrolyte aqueous solution is charged into a 250-mL round-bottom glass beaker dedicated for Multisizer 3. The beaker is set in a sample stand, and the electrolyte aqueous solution in the beaker is stirred with a stirrer rod at 24 rotations/sec in a counterclockwise direction. Then, dirt and bubbles in the aperture tube are removed by the "Flush Aperture" function of the dedicated software.

(2) About 30 mL of the electrolyte aqueous solution is charged into a 100-mL flat-bottom glass beaker. About 0.3 ml of a diluted solution prepared by diluting "Contaminon N" (a 10 mass % aqueous solution of a neutral detergent for washing a precision measuring unit containing a nonionic surfactant, an anionic surfactant, and an organic builder and having a pH of 7, manufactured by Wako Pure Chemical Industries, Ltd.) with ion-exchanged water by about 3 mass fold is added as a dispersant to the electrolyte aqueous solution.

(3) An ultrasonic dispersing unit "Ultrasonic Dispersion System Tetora 150" (manufactured by Nikkaki Bios Co., Ltd.) is prepared in which two oscillators each having an oscillatory frequency of 50 kHz are built so as to be out of phase by 180° and which has an electrical output of 120 W. About 3.3 L of ion-exchanged water is charged into the water tank of the ultrasonic dispersing unit. About 2 mL of Contaminon N is added into the water tank.

(4) The beaker in the section (2) is set in the beaker fixing hole of the ultrasonic dispersing unit, and the ultrasonic dispersing unit is operated. Then, the height position of the beaker is adjusted so that the liquid level of the electrolyte aqueous solution in the beaker resonates to the fullest extent possible.

(5) About 10 mg of the toner is gradually added to and dispersed in the electrolyte aqueous solution in the beaker in the section (4) under a state in which the electrolyte aqueous solution is irradiated with an ultrasonic wave. Then, the ultrasonic dispersion treatment is continued for an additional 60 seconds. It should be noted that the temperature of water in the water tank is appropriately adjusted to the range of from 10° C. to 40° C. upon ultrasonic dispersion.

(6) The electrolyte aqueous solution in the section (5) in which the toner has been dispersed is dropped with a pipette to the round-bottom beaker in the section (1) placed in the sample stand, and the concentration of the toner to be measured is adjusted to about 5%. Then, measurement is performed until the particle diameters of 50,000 particles are measured.

(7) The measurement data is analyzed with the dedicated software included with the apparatus, and the weight average particle diameter (D4) is calculated. It should be noted that the "Average Diameter" on the "Analysis/Volume Statistics (Arithmetic Average)" screen of the dedicated software when the dedicated software is set to show a graph in a vol % unit is the weight average particle diameter (D4).

EXAMPLES

The present invention is described in more detail below by way of Examples and Comparative Examples. However, the present invention is by no means limited thereto.

Crystalline resins 1 to 3 shown in Table 1 below were prepared as crystalline resins. Monomers used in the synthesis of the crystalline resins and their endothermic peaks are also shown in Table 1.

TABLE 1

| | Composition | Endothermic peak (° C.) |
|---|---|---|
| Crystalline resin 1 | Polyester resin (Sebacic acid/1,12-dodecanediol) | 85 |
| Crystalline resin 2 | Polyester resin (Fumaric acid/1,6-hexanediol) | 115 |
| Crystalline resin 3 | Polyester resin (Sebacic acid/1,9-dodecanediol) | 65 |

<Production Example of Organic-inorganic Composite Fine Particles 1>

10 Grams of the crystalline resin 1 and 40 g of toluene were loaded into a reaction vessel mounted with a stirring machine, a condenser, a temperature gauge, and a nitrogen-introducing tube, and the resin was dissolved in toluene by heating the mixture to 60° C.

Next, while the solution was stirred, 0.8 g of a dialkyl sulfosuccinate (trade name: SANMORIN OT-70, manufactured by Sanyo Chemical Industries, Ltd.), 0.17 g of dimethylaminoethanol, and 20 g of an organosilica sol (silica fine particles, trade name: ORGANOSILICA SOL MEK-ST-40, manufactured by Nissan Chemical Industries, Ltd., average particle diameter: 15 nm, solid mass ratio: 40%) serving as inorganic fine particles were added.

Subsequently, under a state in which the mixture was stirred, phase-transfer emulsification was performed while 60 g of water was added at a rate of 2 g/min. Subsequently, a temperature in the reaction vessel was set to 40° C., and toluene was removed while the resultant was bubbled with nitrogen at 100 ml/min. Thus, a dispersion liquid of organic-inorganic composite fine particles 1 was obtained. The solid content concentration of the dispersion liquid was adjusted to 30%.

<Production Example of Organic-inorganic Composite Fine Particles 2>

A dispersion liquid of organic-inorganic composite fine particles 2 was obtained in the same manner as in the production example of the organic-inorganic composite fine particles 1 except that in the production example of the organic-inorganic composite fine particles 1, the resin to be used was changed to the crystalline resin 2 and the amount of dimethylaminoethanol was changed to 0.56 g. The solid content concentration of the dispersion liquid was adjusted to 30%.

<Production Example of Organic-inorganic Composite Fine Particles 3>

A dispersion liquid of organic-inorganic composite fine particles 3 was obtained in the same manner as in the production example of the organic-inorganic composite fine particles 1 except that in the production example of the organic-inorganic composite fine particles 1, the resin to be used was changed to the crystalline resin 3 and the amount of dimethylaminoethanol was changed to 0.11 g. The solid content concentration of the dispersion liquid was adjusted to 30%.

<Production Example of Organic-inorganic>Composite Fine Particles 4

860 Grams of water and 196 g of an organosilica sol (silica fine particles, trade name: ORGANOSILICA SOL MEK-ST-40, manufactured by Nissan Chemical Industries, Ltd., average particle diameter: 15 nm, solid mass ratio: 40%) serving as inorganic fine particles were loaded into a reaction vessel mounted with a stirring machine, a condenser, a temperature gauge, and a nitrogen-introducing tube. Subsequently, 20 g of butyl acrylate and 78 g of styrene were added to the reaction vessel, and the temperature of the mixture was increased to 60° C. by heating while the mixture was stirred. Thus, an emulsified particle solution was produced. Subsequently, 5 g of a 50 mass % solution of 2,2'-azobis(2,4-dimethylvaleronitrile) in toluene serving as a polymerization initiator was added to the emulsified particle solution, and a polymerization reaction was performed by holding the mixture at 60° C. for 4 hours. After that, the resultant was filtered and dried to provide organic-inorganic composite fine particles 4.

<Production Example of Organic-inorganic Composite Fine Particles 5>

A dispersion liquid of organic-inorganic composite fine particles 5 was obtained in the same manner as in the production example of the organic-inorganic composite fine particles 1 except that in the production example of the organic-inorganic composite fine particles 1, the addition amount of the organosilica sol was changed to 10 g. The solid content concentration of the dispersion liquid was adjusted to 30%.

<Production Example of Resin Fine Particles 1>

A dispersion liquid of resin fine particles 1 was obtained in the same manner as in the production example of the organic-inorganic composite fine particles 1 except that in the production example of the organic-inorganic composite fine particles 1, the organosilica sol was not used. The solid content concentration of the dispersion liquid was adjusted to 30%.

<Production Example of Resin Fine Particles 2>

A dispersion liquid of resin fine particles 2 was obtained in the same manner as in the production example of the organic-inorganic composite fine particles 4 except that in the production example of the organic-inorganic composite fine particles 4, the organosilica sol was not used. The solid content concentration of the dispersion liquid was adjusted to 30%.

<Production Example of Toner Particles 1>

Amorphous polyester resin (Tg: 59° C., softening point Tm: 112° C.): 100 parts by mass Magnetic iron oxide particles: 75 parts by mass Fischer-Tropsch wax (manufactured by Sasol Wax, C105, melting point: 105° C.): 2 parts by mass Charge control agent (manufactured by Hodogaya Chemical Co., Ltd., T-77): 2 parts by mass The materials were premixed with a Henschel mixer, and then the mixture was melted and kneaded with a biaxial extruder (trade name: PCM-30, manufactured by Ikegai Ironworks Corp.) while its temperature was set so that the temperature of a molten product at an ejection port became 150° C.

The resultant kneaded product was cooled and coarsely pulverized with a hammer mill. After that, the coarsely pulverized product was finely pulverized with a pulverizer (trade name: Turbo Mill T250, manufactured by Turbo Kogyo Co., Ltd.). The resultant finely pulverized powder was classified with a multi-division classifier utilizing the Coanda effect to provide toner particles 1 having a weight average particle diameter (D4) of 7.2 μm. The toner particles 1 each had a softening point Tm of 120° C.

<Production Example of Toner 1>

Organic-inorganic composite fine particles were externally added to the toner particles 1 by a wet method as described below.

"Contaminon N" (trade name, manufactured by Wako Pure Chemical Industries, Ltd.) was added to 2,000 parts by mass of water, and 100 parts by mass of the toner particles were further dispersed in the mixture. While the resultant toner particle dispersion liquid was stirred, 3 parts by mass of the dispersion liquid of the organic-inorganic composite fine particles 1 (having a solid content concentration of 30%) was added thereto. Subsequently, the temperature of the mixture was held at 50° C. and the mixture was continuously stirred for 2 hours so that the organic-inorganic composite fine particles 1 were adhered to the surfaces of the toner particles 1. Next, the resultant was filtered and dried to provide particles in which the organic-inorganic composite fine particles 1 were externally added to the surfaces of the toner particles 1. Further, fumed silica (BET: 200 $m^2/g$) was externally added to and mixed with the particles in an amount of 1.5 parts by mass with respect to 100 parts by mass of the toner particles 1 by using a Henschel mixer. Further, the particles having externally added thereto the fumed silica were sieved with a mesh having an aperture of 150 μm to provide a toner 1. The physical properties of the organic-inorganic composite fine particles 1 are shown in Table 3. The graph of the loss elastic modulus (G") of the organic-inorganic composite fine particles 1 is shown in FIGURE.

<Production Example of Toner 2>

A toner 2 was obtained in the same manner as in the production example of the toner 1 except that the organic-inorganic composite fine particles 2 were used instead of the organic-inorganic composite fine particles 1. The physical properties of the organic-inorganic composite fine particles 2 are shown in Table 3.

<Production Example of Toner 3>

A toner 3 was obtained in the same manner as in the production example of the toner 1 except that the organic-inorganic composite fine particles 3 were used instead of the organic-inorganic composite fine particles 1. The physical properties of the organic-inorganic composite fine particles 3 are shown in Table 3.

<Production Example of Toner 4>

A toner 4 was obtained in the same manner as in the production example of the toner 1 except that the organic-inorganic composite fine particles 5 were used instead of the organic-inorganic composite fine particles 1. The physical properties of the organic-inorganic composite fine particles 5 are shown in Table 3.

<Production Example of Comparative Toner 1>

A comparative toner 1 was obtained in the same manner as in the production example of the toner 1 except that the organic-inorganic composite fine particles 4 were used instead of the organic-inorganic composite fine particles 1. The physical properties of the organic-inorganic composite fine particles 4 are shown in Table 3.

<Production Example of Comparative Toner 2>

A comparative toner 2 was obtained in the same manner as in the production example of the toner 1 except that the resin fine particles 1 were used instead of the organic-inorganic composite fine particles 1. The physical properties of the resin fine particles 1 are shown in Table 3. Their loss elastic modulus (G") became lower than $1.0\times10^3$ dN/m$^2$ at 85° C. and hence the measurement was stopped at the time point.

<Production Example of Comparative Toner 3>

A comparative toner 3 was obtained in the same manner as in the production example of the toner 1 except that the resin fine particles 2 were used instead of the organic-inorganic composite fine particles 1. The physical properties of the resin fine particles 2 are shown in Table 3. Their loss elastic modulus (G") became lower than $1.0\times10^3$ dN/m$^2$ at 122° C. and hence the measurement was stopped at the time point.

<Production Example of Comparative Toner 4>

0.9 Part by mass of colloidal silica (particle diameter: 120 nm) and 1.5 parts by mass of fumed silica (BET: 200 m$^2$/g) were externally added to and mixed with 100 parts by mass of the toner particles 1 by using a Henschel mixer, and the mixture was sieved with a mesh having an aperture of 150 μm to provide a comparative toner 4. The physical property of the colloidal silica is shown in Table 3. Its loss elastic modulus (G") could not be measured.

The external additives used in the toners 1 to 4 and the comparative toners 1 to 4, and the addition amounts of the external additives with respect to 100 parts by mass of the toner particles are shown in Table 2. The physical properties of the organic-inorganic composite fine particles, the resin fine particles, and the colloidal silica are shown in Table 3. In addition, observation with a scanning electron microscope confirmed that in each of the organic-inorganic composite fine particles 1 to 5, the inorganic fine particles were embedded in the resin fine particles.

TABLE 2

| Toner | Toner particles | External additive addition amount (with respect to 100 parts by mass of toner particles) | | | |
|---|---|---|---|---|---|
| Toner 1 | Toner particles 1 | Organic-inorganic composite fine particles 1 | 0.9 | Fumed silica | 1.5 |
| Toner 2 | Toner particles 1 | Organic-inorganic composite fine particles 2 | 0.9 | Fumed silica | 1.5 |
| Toner 3 | Toner particles 1 | Organic-inorganic composite fine particles 3 | 0.9 | Fumed silica | 1.5 |
| Toner 4 | Toner particles 1 | Organic-inorganic composite fine particles 5 | 0.9 | Fumed silica | 1.5 |
| Comparative Toner 1 | Toner particles 1 | Organic-inorganic composite fine particles 4 | 0.9 | Fumed silica | 1.5 |
| Comparative Toner 2 | Toner particles 1 | Resin fine particles 1 | 0.9 | Fumed silica | 1.5 |
| Comparative Toner 3 | Toner particles 1 | Resin fine particles 2 | 0.9 | Fumed silica | 1.5 |
| Comparative Toner 4 | Toner particles 1 | Colloidal silica | 0.9 | Fumed silica | 1.5 |

TABLE 3

| Toner | Physical properties of organic-inorganic composite fine particles, resin fine particles, and colloidal silica | | | |
|---|---|---|---|---|
| | Number average particle diameter of primary particles (D1)/(nm) | Temperature at which d(Log(G"$_T$))/dT has minimum/(° C.) | Minimum of d(Log(G"$_T$))/dT | Loss elastic modulus (G"$_{180}$)/(dN/m$^2$) |
| Toner 1 | 135 | 79 | −0.23 | $3.3\times10^6$ |
| Toner 2 | 122 | 110 | −0.20 | $5.6\times10^6$ |
| Toner 3 | 98 | 62 | −1.09 | $9.0\times10^5$ |
| Toner 4 | 252 | 80 | −0.16 | $4.8\times10^4$ |
| Comparative Toner 1 | 129 | 68 | −0.09 | $4.0\times10^5$ |
| Comparative Toner 2 | 140 | 83 | −2.73 | Temperature did not reach 180° C. |
| Comparative Toner 3 | 152 | 91 | −2.84 | Temperature did not reach 180° C. |
| Comparative Toner 4 | 120 | Unmeasurable | Unmeasurable | Unmeasurable |

Example 1

In this example, a commercially available magnetic one-component-type printer HP LaserJet Enterprise 600 M603dn (manufactured by Hewlett-Packard Company, process speed: 350 mm/s) was used as an apparatus to be used in an evaluation. In the evaluation machine, the following evaluations were performed by using the toner 1. The results of the evaluations are shown in Table 4.

[Evaluation for Developability]

The toner was loaded into a predetermined process cartridge. An image output test was performed on a total of 5,000 sheets according to a mode set so that the printing of a horizontal line pattern having a print percentage of 2% on 2 sheets was defined as one job, and the apparatus stopped once between a job and a next job before the next job started. Image densities on a 10th sheet and a 5,000th sheet were measured. Evaluations were performed under normal temperature and normal humidity (temperature: 25.0° C., relative humidity: 60%), and under high temperature and high humidity (temperature: 32.5° C., relative humidity: 85%) severe for developability. The image densities were each measured by measuring the reflection density of a 5-mm round solid image with a Macbeth densitometer (manufactured by Macbeth) serving as a reflection densitometer and an SPI filter. A larger numerical value for the image density means that the developability is better.

[Evaluation for Low-temperature Fixability]

A fixing apparatus was reconstructed so that its fixation temperature could be arbitrarily set. A halftone image was output on bond paper (75 g/m$^2$) so as to have an image density of from 0.6 to 0.65 with the apparatus while the temperature of its fixing unit was controlled in the range of from 180° C. to 220° C. every 5° C. The resultant image was rubbed with lens-cleaning paper to which a load of 4.9 kPa had been applied 5 reciprocations, and the lowest temperature at which the percentage by which the image density reduced after the rubbing as compared with that before the rubbing became 10% or less was used as a criterion for an evaluation for low-temperature fixability. A lower value for the temperature means that the low-temperature fixability is better.

[Evaluation for High Temperature-resistant Offset Property]

The process speed of the printer was reconstructed from 350 mm/s to 200 mm/s for establishing an evaluation condition under which a high-temperature offset was liable to occur. Plain paper having a basis weight of g/m$^2$ was used in an evaluation. A horizontal line pattern having a print percentage of 2% was output on 500 sheets of A5-size paper, and then a horizontal line pattern having a print percentage of 2% was continuously output on 100 sheets of A4-size paper. The number of sheets of the A4-size paper in which end portion offsets occurred at their end portions was visually observed, and the evaluation was performed by the following criterion. A smaller number of the sheet on which the high-temperature offset disappears means that the toner is more excellent in resistance to an end portion high-temperature offset. The evaluation was performed under a normal-temperature and normal-humidity environment (25.0° C., 60% RH).

With regard to Example 1, a satisfactory result was obtained in each of the evaluations.

Examples 2 to 4 and Comparative Examples 1 to 4

The same evaluations as those of Example 1 were performed by using the toners 2 to 4 and the comparative toners 1 to 4. The results of the evaluations are shown in Table 4.

TABLE 4

| | | Normal-temperature and normal-humidity environment Image density | | High-temperature and high-humidity environment Image density | | Low-temperature | High temperature- |
|---|---|---|---|---|---|---|---|
| | Toner | 10th sheet | 5,000th sheet | 10th sheet | 5,000th sheet | fixability (° C.) | resistant offset property |
| Example 1 | Toner 1 | 1.42 | 1.40 | 1.40 | 1.38 | 180 | High-temperature offset disappeared on 10th sheet |
| Example 2 | Toner 2 | 1.42 | 1.40 | 1.41 | 1.37 | 185 | High-temperature offset disappeared on 9th sheet |
| Example 3 | Toner 3 | 1.40 | 1.39 | 1.40 | 1.36 | 175 | High-temperature offset disappeared on 12th sheet |
| Example 4 | Toner 4 | 1.41 | 1.38 | 1.39 | 1.34 | 180 | High-temperature offset disappeared on 16th sheet |
| Comparative Example 1 | Comparative toner 1 | 1.40 | 1.39 | 1.40 | 1.38 | 200 | High-temperature offset disappeared on 14th sheet |
| Comparative Example 2 | Comparative toner 2 | 1.39 | 1.37 | 1.32 | 1.11 | 180 | High-temperature offset disappeared on 28th sheet |
| Comparative Example 3 | Comparative toner 3 | 1.40 | 1.37 | 1.35 | 1.23 | 185 | High-temperature offset disappeared on 23rd sheet |
| Comparative Example 4 | Comparative toner 4 | 1.41 | 1.38 | 1.40 | 1.35 | 215 | High-temperature offset disappeared on 16th sheet |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-001936, filed Jan. 8, 2015, and Japanese Patent Application No. 2015-240889, filed Dec. 10, 2015, which are hereby incorporated by reference herein in their entirety.

What is claimed is:

1. A toner, comprising:

a toner particle; and an organic-inorganic composite fine particle on a surface of the toner particle, the organic-inorganic composite fine particle having a number average particle diameter of a primary particle of 30 nm to 500 nm and comprising:

a resin fine particle is a particle of a crystalline polyester; and an inorganic fine particle which is embedded in the resin fine particle and part of which is exposed to a surface of the resin fine particle, wherein the organic-inorganic composite fine particle satisfies relationships (i) and (ii):

(i) in viscoelasticity measurement of the organic-inorganic composite fine particle, a minimum of d(Log($G''_T$))/dT is less than −0.10 in a range of from 60° C. to 150° C. when a loss elastic modulus thereof at a temperature T (° C.) is represented by $G''_T$ [dN/m$^2$] and a change ratio of a common logarithm of the loss elastic modulus is represented by d(Log($G''_T$))/dT, and (ii) in the viscoelasticity measurement of the organic-inorganic composite fine particle, $G''_{180}$ is $1.0\times10^4$ to $1.0\times10^7$ dN/m$^2$ when a loss elastic modulus thereof at a temperature of 180° C. is represented by $G''_{180}$.

2. A toner according to claim 1, wherein the inorganic fine particle is at least one kind selected from the group consisting of a silica fine particle, an alumina fine particle, a titania fine particle, a zinc oxide fine particle, a strontium titanate fine particle, a cerium oxide fine particle, and a calcium carbonate fine particle.

3. A toner according to claim 1, wherein the number average particle diameter of the primary particles of the inorganic fine particles is 5 to 100 nm.

4. A toner according to claim 1, wherein the addition amount of the inorganic fine particle in the organic-inorganic composite fine particle is 10 to 80 parts by mass with respect to 100 parts by mass of the organic-inorganic composite fine particle.

5. A toner, comprising:

a toner particle; and an organic-inorganic composite fine particle on a surface of the toner particle, the organic-inorganic composite fine particle having a number average particle diameter of a primary particle of 30 nm to 500 nm and comprising:

a resin fine particle is a particle of a crystalline polyester; and an inorganic fine particle which is embedded in the resin fine particle and part of which is exposed to a surface of the resin fine particle, wherein the organic-inorganic composite fine particle satisfies relationships (i) and (ii):

(i) in viscoelasticity measurement of the organic-inorganic composite fine particle, a minimum of d(Log($G''_T$))/dT is from −1.09 to −0.16 in a range of from 62° C. to 110° C. when a loss elastic modulus thereof at a temperature T (° C.) is represented by $G''_T$ [dN/m$^2$] and a change ratio of a common logarithm of the loss elastic modulus is represented by d(Log($G''_T$))/dT, and (ii) in the viscoelasticity measurement of the organic-inorganic composite fine particle, $G''_{180}$ is $4.8\times10^4$ to $5.6\times10^6$ dN/m$^2$ when a loss elastic modulus thereof at a temperature of 180° C. is represented by $G''_{180}$.

6. A toner according to claim 1, wherein the inorganic fine particle is a silica fine particle.

7. A toner according to claim 1, wherein in viscoelasticity measurement of the organic-inorganic composite fine particle, the minimum of d(Log($G''_T$))/dT is less than −0.16 in a range of from 62° C. to 110° C.

8. A toner according to claim 1, wherein in the viscoelasticity measurement of the organic-inorganic composite fine particle, the $G''_{180}$ is $4.8\times10^4$ to $5.6\times10^6$ dN/m$^2$.

* * * * *